United States Patent [19]

Yamamoto

[11] 4,098,425

[45] Jul. 4, 1978

[54] LOW TEMPERATURE LIQUEFIED GAS TANK

[75] Inventor: Katsuro Yamamoto, Tokyo, Japan

[73] Assignee: Bridgestone Liquefied Gas Co., Ltd., Tokyo, Japan

[21] Appl. No.: 471,790

[22] Filed: May 20, 1974

[30] Foreign Application Priority Data

May 28, 1973 [JP] Japan ..... 48-59584

[51] Int. Cl.[2] ..... B65D 87/24; B63B 25/16

[52] U.S. Cl......220/403; 220/71; 220/901; 220/437

[58] Field of Search ..... 220/9 LG, 14, 15, 63 R, 220/71, 85 B, 3

[56] References Cited

U.S. PATENT DOCUMENTS

| | | | |
|---|---|---|---|
| 3,031,856 | 5/1962 | Wiedeman et al. | 220/9 LG X |
| 3,613,932 | 10/1971 | Yamamoto | 220/9 LG |
| 3,724,703 | 4/1973 | Yamamoto | 220/9 LG |
| 3,815,773 | 6/1974 | Duvall et al. | 220/3 |

*Primary Examiner*—Stephen Marcus

*Attorney, Agent, or Firm*—Birch, Stewart, Kolasch and Birch

[57] ABSTRACT

A low temperature liquefied gas tank of the membrane type including a membraneous inner vessel having a rectangular parallelepiped shape with substantially spherical corner portions, wherein each of said corner portions is provided with a membraneous patch member which is shaped to follow said corner portion and is connected to said inner vessel at its rim portion in a fluid-tight manner.

9 Claims, 2 Drawing Figures

LOW TEMPERATURE LIQUEFIED GAS TANK

BACKGROUND OF THE INVENTION

1. Field of the Invention

The present invention relates to a low temperature liquefied gas tank of the membrane type for housing low temperature liquefied gases such as petroleum gases which are in a gaseous state at atmospheric temperature and can be liquefied by being cooled under atmospheric pressure.

2. Description of the Prior Art

Conventionally, a tank for the aforementioned purpose is generally composed to an outer vessel of a rigid and pressure resistant structure, a compression resistant heat insulating layer provided at the inside of said outer vessel and an inner membraneous vessel provided at the inside of said heat insulating layer, said inner membraneous vessel being made of a relatively thin plate and adapted to be readily flexed by internal pressure applied thereto so as to come into close contact with the inner surface of said heat insulating layer, whereby the internal pressure is finally supported by the outer vessel by way of said heat insulating layer. With regard to a tank of this kind, in the case where the inner membraneous vessel has a rectangular parallelepiped shape having substantially spherical corner portions (generally called "ball corner"), portions A (FIG. 2.) adjacent to the spherical corner portions are subject to a high bending stress and there is the danger that a breakage may occur at portion A due to overstressing beyond the fatigue limit.

SUMMARY OF THE INVENTION

Therefore, it is the object of the present invention to solve the aforementioned problem and to provide an improved low temperature liquefied gas tank of the membrane type wherein the portions of the inner membraneous vessel located adjacent to the ball corners are efficiently protected so as to improve the reliability of the inner membraneous vessel.

According to the present invention, the abovementioned object is accomplished by providing each of said corner portions with a membraneous patch member which is shaped to follow said corner portion and is fluid-tightly connected to said inner vessel at its rim portion.

In the low temperature liquefied gas tank of the membrane type according to the present invention, the portions of the inner membraneous vessel which are located adjacent to the ball corner portions and tend to be subjected to a high bending stress are fluid-tightly covered with membraneous patch members which are connected to the inner membraneous vessel at their rim portions (periphery) so that each ball corner portion is deformable according to its expansion or contraction without being restricted by said patch member. If a breakage does occur at the aforementioned portion, the fluid tightness of the inner membraneous vesel is assured by said patch member, thus providing a tank of high reliability.

According to the present invention, said patch member may be attached either at the inside or outside of said inner membraneous vessel.

Said patch member may preferably be made of the same material as said inner vessel. In this case, said patch member may preferably be thinner than said inner vessel.

Alternatively, according to another particular feature of the present invention, said patch member may be made of a material having substantially the same coefficient of thermal expansion as said inner vessel. According to still another particular feature of the present invention, said patch member may be made of a material having a larger elongation than the material forming said inner vessel so that expansion or contraction of the inner vessel due to changes of temperature and/or load is not unduly restricted by the patch member.

According to still another feature of the present invention, the space confined between said inner vessel and said patch member is preferably evacuated. In this connection, a breakage which has occurred either in the corner portion of the inner vessel or in the patch member can be readily detected if the level of the vacuum in said space is monitored. Furthermore, if the content of the gases residing in the space confined between said inner vessel and said patch member is periodically analyzed, it can easily be determined whether the inner vessel or the patch member has been damaged.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENT

In the following, the present invention will be described in more detail with respect to the preferred embodiment and with particular reference to the accompanying drawing.

Figure 1:
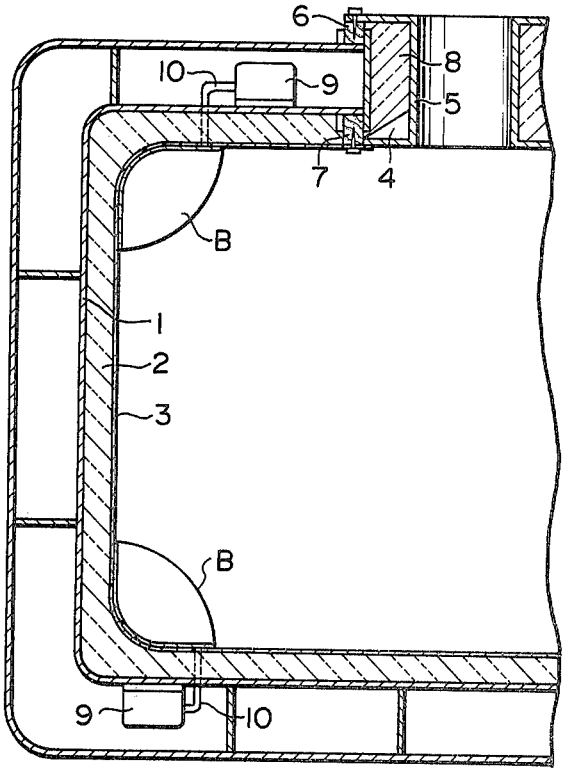
FIG. 1 is a cross sectional view of a part of a low temperature liquefied gas tanker ship in which the present invention is incorporated, and, FIG. 2 is a perspective view of the inner vessel incorporated in the tank structure shown in FIG. 1.
Figure 2:
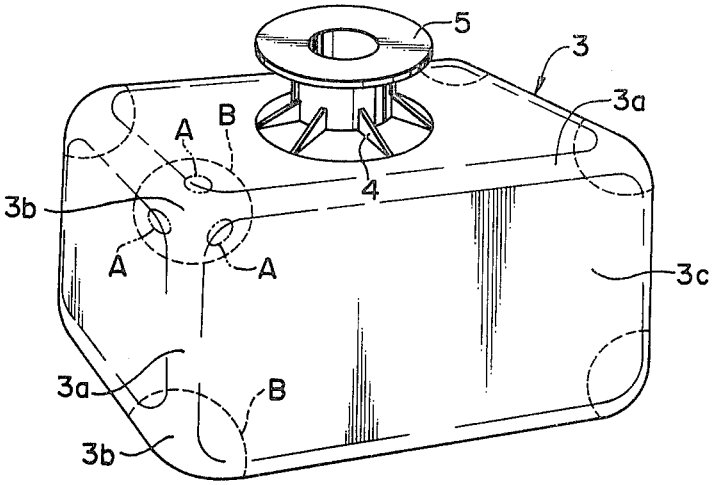

As shown in FIG. 1, a low temperature liquefied gas tanker ship generally comprises a shell 1 formed as a dual-walled structure containing a rigid outer vessel, a heat insulating layer 2 of a compression resistant material and an inner membraneous vessel 3, which, as shown in FIG. 2. has a rectangular parallelepiped shape with substantially cylindrically curved edge portions 3*a*, substantially spherically shaped corner portions (ball corners) 3*b* and flat portions 3*c*.

The heat insulating layer 2 is made of a material such as hard polyurethane foam which is compression resistant by itself or a heat-insulating layer may be an assembled structure containing wooden frames and granular pearlite, the latter filling spaces left in the former.

According to the present invention, a membraneous patch member B is provided to cover each ball corner 3*b* and portions A located adjacent to said ball corner of the inner vessel 3, said patch member being welded in a fluid-tight manner to the inner vessel 3 at its rim portion.

When the inner vessel 3 is made of, e.g. a plate of stainless steel having thickness of 4–5mm, the membraneous patch member B may be made of a stainless steel plate having a thickness of 1mm. Using this arrangement, the patch member B deforms in the same manner as the ball corner portion of the inner vessel according to the expansion or contraction due to change of temperature. When an internal pressure is applied to the corner portion, the patch member carries a substantially smaller load as compared with the ball corner portion, whereby a high stress concentration is avoided in the rim portion of the patch member as well as the corresponding portion of the inner vessel, both being welded together. In the same principle, the patch member B may be made of a material other than that of the inner vessel, said material, however, having substantially the same thermal coefficient of expansion as the inner vessel. In this case, it is more favorable that the material which is used to form the patch member has a smaller modulus of elasticity than the material forming the inner vessel.

The central portion of the roof of the inner vessel 3 is firmly and fluid-tightly mounted to a lower flange portion of a rigid trunk 5 reinforced by brackets 4. The rigid trunk 5 is firmly mounted to the dual-walled hull 1 at its upper and lower flange portions by way of blocks 6 and 7 made of a heat insulating material. The space formed between the hull 1 and the trunk 5 is filled with a heat insulating material 8 so that the low temperature in the inner vessel does not affect the hull structure.

Loading and unloading pipes, gas pipes and other piping systems to be introduced into the inner vessel 3 are passed through the trunk 5, which, in fact, is closed by a fluid-tight cover (not shown) through which said piping system is passed in a fluid-tight manner.

A vacuum pump 9 is mounted on the hull 1, a suction port for said pump being connected to a fluid tight space formed between the patch member B and the inner vessel 3 by means of a pipe 10. The fluid tight space is maintained in vacuum whereby the patch member B and the inner vessel 3 are in tight contacted with each other.

Therefore, even when the internal pressure in the inner vessel 3 lowers to zero or atmospheric pressure in the case of maintenance or inspection of the vessel, the patch member B can be held in tight contact with the ball corner portion of the inner vessel, whereby the rigidity of the corner portion of the inner vessel is advantageously increased so as to support the inner vessel by itself and prevent it from falling down due to its own gravity.

When the inner vessel 3 has been loaded with low temperature liquefied gases, the inner vessel as well as the patch members B deform due to their contraction. In this case, if the patch member is made of the same material as the inner vessel or a material having substantially the same coefficient of thermal expansion as the inner vessel, no substantial stress due to a relative deformation between the two members will be generated. This is also true in the case where the patch member is made of a material having a smaller modulus of elasticity than the material forming the inner vessel.

If damage or breakage has been caused in the portion A which is subject to a high bending stress, the patch member B prevents any leakage of low temperature liquefied gases from the inner vessel 3. If the breakage has been caused in the portion A or the patch member B, the vacuum in the space confined therebetween lowers, whereby said breakage is readily detected if the vacuum in said space is monitored by pipe 10. Of course, when a breakage occurs in the inner vessel, a suitable countermeasure, such as a transfer of the low temperature liquefied gases contained in the tank to another, may be taken.

Furthermore, if the gases drawn through the pipe 10 are analyzed, it can be readily determined if a lowering of the vacuum in said space is due to a breakage of the inner layer, that is, in the embodiment shown in FIGS. 1 and 2, the patch member B.

In this connection, although the patch member B is provided at the inside of the inner vessel 3 in the embodiment shown in FIGS. 1 and 2, the patch member B may be provided at the outside of the inner vessel 3 to accomplish substantially the same effect.

From the foregoing, it will be appreciated that the low temperature liquefied gas tank of the membrane type according to the present invention provides a high reliability since the portions A of the inner vessel which are mostly subject to damage in operation are effectively protected by the patch members B and furthermore, any breakage which may occur in said portions A is readily detected by employing the patch members B with the help of a readily available vacuum and gas analyzing system. Thus, a tanker ship equipped with low temperature liquefield gas tanks according to this invention has a high reliability in its service of transporting low temperature liquefied gases.

The invention being thus described, it will obvious that the same may be varied in many ways. Such variations are not to be regarded as a departure from the spirit and scope of the invention, and all such modifications as would be obvious to one skilled in the art are intended to be included within the scope of the following claims.

I claim:

1. A low temperature liquefied gas tank comprising a rigid outer vessel, a compression-resistant, heat-insulating layer provided at the inside of said outer vessel and an inner membranous vessel provided at the inside of said heat-insulating layer, said inner membranous vessel having substantially spherical corner portions, said spherical corner portions being provided with a membranous patch member which covers only said corner portions, said patch member being shaped to follow said corner portion and being connected to said inner vessel at its rim portion in a fluid-tight manner, and means for evacuating a space confined between said inner membranous vessel and said patch member.

2. A low temperature liquefied gas tank according to claim 1, wherein said patch member is attached at the inside of said inner vessel.

3. A low temperature liquefied gas tank according to claim 1, wherein said patch member is attached at the outside of said inner vessel.

4. A low temperature liquefied gas tank according to claim 1, wherein said patch member is made of the same material as said inner vessel.

5. A low temperature liquefied gas tank according to claim 4, wherein said patch member is thinner than said inner vessel.

6. A low temperature liquefied gas tank according to claim 1, wherein said patch member is made of a material having substantially the same coefficient of thermal expansion as said inner vessel.

7. A low temperature liquefied gas tank according to claim 1, wherein said patch member is made of a material having a larger elongation than the material forming said inner vessel.

8. A low temperature liquefied gas tank according to claim 1, wherein said means includes a conduit which provides communication between said space and a vacuum monitoring device or a gas analyzing device.

9. The low temperature liquefied gas tank of claim 1, wherein the inner membranous vessel has a rectangular parallelepiped shape.

* * * * *